US012339111B2

(12) United States Patent
Garcia-Gamon Anton et al.

(10) Patent No.: US 12,339,111 B2
(45) Date of Patent: Jun. 24, 2025

(54) IGNITION ARRANGEMENT FOR MULTIPLE PYROTECHNIC ARTICLES

(71) Applicants: Fernando Garcia-Gamon Anton, Godella (ES); Antonio Manuel Garcia-Gamon Valero, Betera (ES)

(72) Inventors: Fernando Garcia-Gamon Anton, Godella (ES); Antonio Manuel Garcia-Gamon Valero, Betera (ES); Jose Maria Martinez Jiminez, Benifairo de les Valls (ES)

(73) Assignees: Fernando Garcia-Gamon Anton, Valencia (ES); Antonio Manuel Garcia-Gamon Valero, Valenicia (ES)

( * ) Notice: Subject to any disclaimer, the term of this patent is extended or adjusted under 35 U.S.C. 154(b) by 110 days.

(21) Appl. No.: 18/029,484

(22) PCT Filed: Sep. 30, 2021

(86) PCT No.: PCT/ES2021/070709

§ 371 (c)(1),
(2) Date: Aug. 18, 2023

(87) PCT Pub. No.: WO2022/069784

PCT Pub. Date: Apr. 7, 2022

(65) Prior Publication Data

US 2024/0053129 A1 Feb. 15, 2024

(30) Foreign Application Priority Data

Oct. 2, 2020 (ES) ..... ES202030995

(51) Int. Cl.

| | |
|---|---|
| ***F42D 1/04*** | (2006.01) |
| ***C06C 5/06*** | (2006.01) |
| ***F42B 4/24*** | (2006.01) |

(52) U.S. Cl.
CPC ..... *F42D 1/043* (2013.01); *C06C 5/06* (2013.01); *F42B 4/24* (2013.01)

(58) Field of Classification Search
CPC . F42D 1/043; F42D 1/055; F42D 1/06; F42D 1/04; C06C 5/06; F42B 4/14; F42B 4/24
(Continued)

(56) References Cited

U.S. PATENT DOCUMENTS 4,714,017 A * 12/1987 Kelly ..... C06C 5/06 102/275.12
4,714,018 A * 12/1987 Lofgren ..... F42D 1/043 102/275.12

(Continued)

FOREIGN PATENT DOCUMENTS

EP 0385614 A2 9/1990
EP 0624773 A1 11/1994

(Continued)

OTHER PUBLICATIONS

English translation of PCT Opinion in PCT/ES2021/070709 (Year: 2023).*

*Primary Examiner* — James S Bergin
(74) *Attorney, Agent, or Firm* — Breiner & Breiner, L.L.C.

(57) ABSTRACT

Disclosed is an ignition arrangement for multiple pyrotechnic articles, which includes a moulded body including a housing for an igniter cord, and also including sides and partitions. The housing is formed by pairs of parallel ribs separated from one another, the ribs of each pair being joined under the igniter cord, thus forming the bottom of the moulded body. Aligned openings are provided in the igniter cord, having inclined opposing surfaces that converge transversely towards the inside of the igniter cord, such as to channel the ignition sparks scattered in the arrangement towards an area of an ignition fuse held against a corre- (Continued)

sponding opening, such that the fuse is ignited from the igniter cord and ignition spreads to a pyrotechnic element located outside the moulded body.

4 Claims, 3 Drawing Sheets

(58) Field of Classification Search
USPC ..... 102/275.12, 360
See application file for complete search history.

(56) References Cited

U.S. PATENT DOCUMENTS

| | | | | |
|---|---|---|---|---|
| 4,730,560 | A * | 3/1988 | Bartholomew | C06C 5/06 102/275.12 |
| 4,771,694 | A | 9/1988 | Bartholomew et al. | |
| 4,998,478 | A * | 3/1991 | Beck | C06C 5/06 102/275.12 |

FOREIGN PATENT DOCUMENTS

| | | | |
|---|---|---|---|
| EP | 1079200 | A1 | 2/2001 |
| ES | 2149714 | A1 | 11/2000 |
| ES | 2154099 | A1 | 3/2001 |
| FR | 353200 | | 9/1905 |
| FR | 2722780 | A1 | 1/1996 |

* cited by examiner

FIG. 3
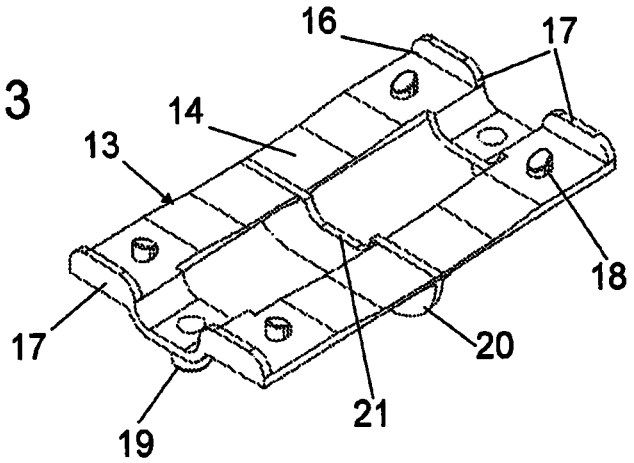
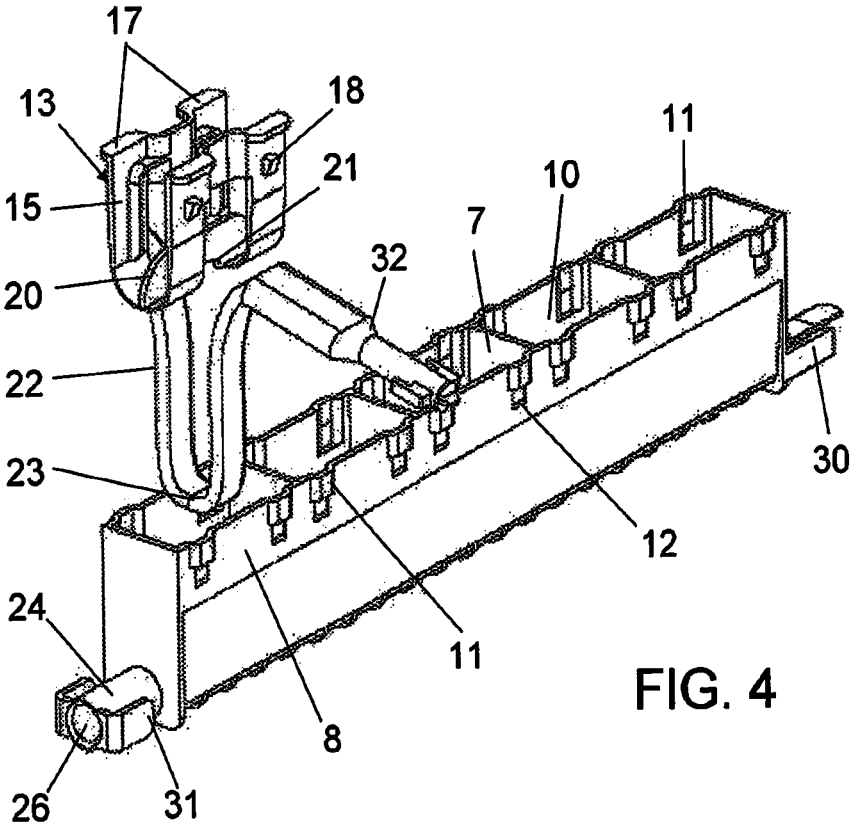
FIG. 4

IGNITION ARRANGEMENT FOR MULTIPLE PYROTECHNIC ARTICLES

TECHNICAL SCOPE

The invention refers to an ignition arrangement for multiple pyrotechnic articles and is applicable in the field of pyrotechnics. More particularly, its scope of application is intended for the field of fireworks as a fire-transmitting element for the progressive, efficient, and safe ignition from a common fuse to the fuses that will individually propagate ignition to pyrotechnic products connected to them, which can be isolated from each other or connected together, for example, contained in a mortar battery.

BACKGROUND OF THE INVENTION

Especially at large events for shooting off fireworks, when the ignition of pyrotechnic products is needed, cluster connection is preferred for economic reasons. Since the ignition fuse connected to each element or pyrotechnic product is also connected at its other end to a common fuse that is usually connected to an ignition device and, since slow-burn transmission speeds are preferred, the mixing of some fire retardant is provided to achieve the required firing sequence. Additionally, and more recently, pyrotechnic ignition fuses in use are protected by kraft paper sheaths or other materials safer against rainwater for the purpose of limiting the spread of sparks and/or flares produced by ignition transmission and to prevent the combustion of nearby fuses or delays. Even the use of ties for cluster connection has been generally applied and, although considerable efforts have been made to replace the ties, the results obtained until now show them to be difficult to apply due to their high preparation and assembly costs. As a precaution, due to their complexity, it is preferred to have the connections made in a workshop by experienced operators, which is expensive.

When pyrotechnic arrangements are used such as the one shown, for example, in documents ES2149714 and ES2154099, it has been found that propagation of the flare transmitted by the ignition fuse to the pyrotechnic element is adequate, although on some occasions, since the connection to the common ignition fuse is made by putting the free end of the ignition fuse close to each pyrotechnic element, the ignition transmission between them is poor. A rigorous case study determined that pyrotechnic professionals use quick ignition fuses, electric matches or squibs, to which they connect a pyrotechnic initiator for ignition propagation to the pyrotechnic products connected to them. In some fuses ignition failure is frequent due to their poor quality and connection. In addition, each manufacturer includes in its own ignition cap, usually a thermoplastic type with different shapes and sizes, variations that add more complexity to the connections and therefore impede ignition propagation. Additionally, upon ignition, the ignition systems that are used emit flares likely to ignite nearby devices, fuses, delays, or other items, which leads to the adoption of additional precautions and an even more complicated assembly process in order to achieve greater safety.

Among pyrotechnic professionals there is a growing interest in fast, accurate, and safe connection of elements for the directed firing of multiple pyrotechnic elements. Patent documents FR 353200A, EP 0385614, EP 0624773, EP 1079200, and ES 2154099 are clear examples of pyrotechnic alternatives with near-term objectives.

PURPOSE OF THE INVENTION

One purpose of the ignition arrangement for multiple pyrotechnic articles according to the invention, maintaining the transmission of ignition along a common fuse, hereinafter called the igniter cord, lies in establishing a certain, precise, and safe cadence of ignition through a series of openings of predefined lengths made separately in the igniter cord already included in the fabrication of a housing provided in the molded body in the pyrotechnic arrangement and abutting at each opening of any intermediate portion of an individual ignition fuse for each pyrotechnic element, with or without a sheath included.

Thus, and different from what is already established in pyrotechnic technique, the ignition arrangement for multiple pyrotechnic articles that the invention is advocating provides a connector to ignite multiple ignition lines that ensures, in each line and up against each opening present in the igniter cord, the immediate connecting and fastening of any intermediate portion of an ignition fuse, with or without a sheath and, in each case, beneath the plastic head that crowns them. In this way, the propagation of the ignition sparks or flares is established in a controlled, efficient, and safe manner from the igniter cord to each one of the ignition fuses connected at its other end to the pyrotechnic products.

Another purpose of the invention is to lengthen the connectors by the arrangement of a connecting female adapter for receiving and holding an end portion of the igniter cord with an attached connector such as, alternatively, to allow for the inclusion of an ignition head in the female connection.

EMBODIMENT OF THE INVENTION

The invention proposes an ignition arrangement for multiple pyrotechnic articles that includes a molded body in which an igniter cord is included in a housing which, in a simplified embodiment, extends lengthwise into the molded body to propagate ignition from one end to the other, in addition to being prepared to ignite any intermediate portions of the multiple ignition fuses which, connected separately to the molded body, will individually transmit ignition to pyrotechnic products outside the pyrotechnic arrangement, for example, pyrotechnic elements contained in mortars or mortar batteries. Ignition propagation to intermediate portions of the ignition fuses is transmitted from a transverse peripheral zone of the igniter cord through at least one opening passing from the outside to the inside of the igniter cord.

Ignition from the igniter cord propagates along the housing further transmitting the ignition flare and ignition sparks to intermediate portions of each ignition fuse through a series of aligned openings on the igniter cord that open from the inside to the outside and each opening in the series of openings is provided with a predetermined length, being the smaller or greater separation between the openings of the igniter cord that achieves the required ignition propagation delay for a series of individual ignition fuses, with each individual ignition fuse placed against a corresponding opening.

The openings are provided with inclined and opposing surfaces that tend to converge on the igniter cord and facilitate the spread of ignition sparks and, depending on the position for use, ensuring the slipping and falling of ignition sparks toward the core of the igniter cord.

Preferably, the openings continue with equal length and follow the same lengthwise alignment with the igniter cord. The lengthwise separation between openings corresponds to portions of the igniter cord without openings and whose lengths determine the delay required for ignition of the ignition fuses placed up against the openings. However, since the openings are allowed to be of equal or different lengths, such portions without openings may also be equal or unequal to each other and, in any case, must be proportionate to the acceleration or delay required to ignite the ignition fuses.

Distributed along the molded body, a series of parallel partitions keeps the openings of the igniter cord isolated from each other, with a separation proportional to that required by the length and established separation between the openings, with the goal of preventing or limiting the spread of ignition flares or sparks from an opening to the next adjacent opening and consequently, avoiding unwanted ignition of fuses in the arrangement.

The molded body presents, on both sides of the igniter cord, side walls or flanks with heights similar to the partitions with which they match up, including the bottom of the molded body, cavities limiting the propagation of ignition flares or sparks to the outside.

Advantageously, the bottom of the molded body is formed, provided with pairs of ribs internally joined under the igniter cord, with the pairs preferably in parallel and separated from each other, matching the housing for the igniter cord along the molded body, in such a way as to constitute a cover for the openings of the igniter cord against rainwater, in a position designed for use.

The flanks include slots impressed into portions of the wall that extend downward from the free upper edge of each flank and below connect with retention sockets adapted to receive the protruding parts of a fuse holder or retainer, formed independently from the molded body, when inserted into one of the cavities between the flanks and partitions in which they are intended to be placed against a corresponding and respective ignition fuse, which holds them.

Such a fuse holder is preferred, consisting of a rectangular plate with an adaptation surface for the cavity and a second surface opposite the adaptation surface. The smaller sides of the plate include extensions that project transversely outward from the adaptation surface to provide support, when the plate is bent in half, on the upper edges of the flanks and thus limit the penetration of the holder into the corresponding cavity intended for its use.

The plate that matches the holder is provided with protruding elements on the adaptation surface and, once bent in half for penetration into one of the cavities provided in the molded body, these elements slide in the guide path defined by the slots impressed into portions of the wall on the flanks and, after a snap-in push, are held in the adjacent retention sockets on the flanks of the molded body, ensuring that the end stop is reached and blocking the upward or downward slip of the holder in the corresponding cavity provided for its use.

On the inner surface and opposite the adaptation surface, the holder includes transverse members that work together as stops to maintain the separation between the smaller sides when the holder has been bent and inserted into any cavity in the molded body, additionally comprising a projection of convenient height that extends centrally and parallel to the upper edges and provides a lower and central notch for pushing against an area of the ignition fuse placed against at least that one opening.

For the purpose of providing an ignition arrangement for multiple pyrotechnic articles of greater length, the molded body in the pyrotechnic arrangement includes a tubular body with an extension at one of its ends and whose tubular hole has a cross section appreciably equal to but greater than the cross section of the final portion, covered or not, of the igniter cord. Thus, an ignition arrangement can be easily and quickly obtained for multiple pyrotechnic articles of greater length by the tight insertion into that first cross section of the final portion, covered or not, of the protruding igniter cord at the opposite end of a similar ignition arrangement for multiple pyrotechnic articles.

Alternatively, when it is not necessary to lengthen the molded body in the pyrotechnic arrangement and instead, if ignition of the same pyrotechnic arrangement is required, provision has been made to reduce the [cross] section of the inner cavity of the tubular body, maintaining the cross section in the short stretch section from the entrance opening to the base of the tubular body and incorporating behind it several radial rails that extend toward the perforated base, which will allow the transmission of the ignition to the igniter cord of the ignition arrangement for multiple pyrotechnic articles. Similarly, when the ignition of several molded bodies connected lengthwise is required, the last one of them provides for the reduction of the section in the tubular body that lengthens it for the inclusion of an ignition initiating element, for example, an electric initiator that will successively transmit ignition to all of them.

DESCRIPTION OF THE DRAWINGS

An embodiment example, without limitation, of an ignition arrangement for multiple pyrotechnic articles is shown in the accompanying drawings, in which:

FIG. 3 shows, according to the invention and taken from the perspective above and on a similar scale as that used in FIGS. 1 and 2, a particular embodiment of the ignition fuse holder in position prior to being bent in half for use.

FIG. 4 shows, taken from the perspective above and on a similar scale as that used in the previous figures, the ignition arrangement for multiple pyrotechnic articles according to the invention, in the position prior to being rotated 180 degrees for its usual application and illustrating the figure of the holder's use prior to contact with a particular area of the ignition fuse, in the forward position above a cavity of the molded body and prior to its placement against an opening of the igniter cord at the bottom of the cavity, once the holder has been inserted into the cavity and is secured in the molded body.

PREFERRED EMBODIMENT OF THE INVENTION

Figure 5:
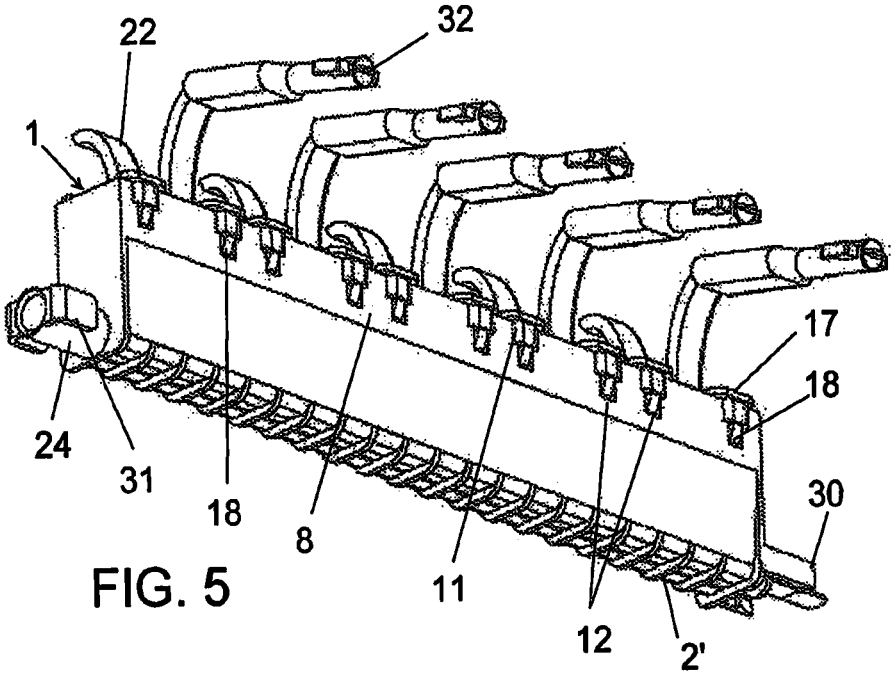
FIG. 5 shows, taken from the perspective below and at a similar scale as that used in FIG. 4, the ignition arrangement for multiple pyrotechnic articles according to the invention, in position prior to being rotated 180 degrees for their usual application and illustrating in a simplified way a position prior to use, in which for greater clarity the ends of the ignition fuses sheathed in commercial thermoplastic heads and the portions of the ignition fuses to be connected to the pyrotechnic elements are shown.
Figure 6:
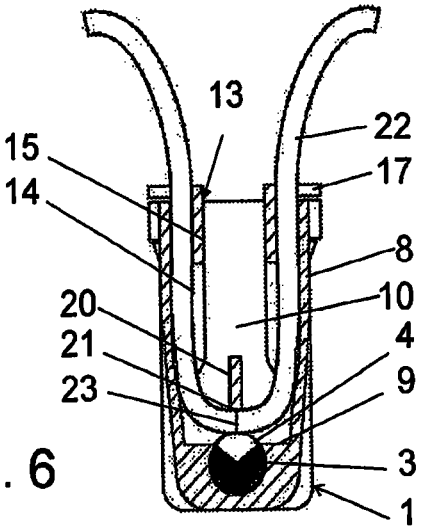
FIG. 6 shows, on a similar scale as that shown in FIG. 5, a simplified cross-section of the ignition arrangement for multiple pyrotechnic articles according to the invention, in a position prior to being rotated 180 degrees for its usual application and illustrating the arrangement of an area of the fuse pressed by the holder against the igniter cord.

In a simplified embodiment according to the invention proposal, as suggested by FIGS. 1 to 6, an ignition arrangement for multiple pyrotechnic articles is comprised of a molded body (1), in the example of an oblong figure, where during the molding process an igniter cord (3) has been included in a housing (2) that extends along the molded body (1). In the example, the housing (2) is seen to be formed by pairs of ribs (2') arranged in parallel and separated from each other and the ribs of each pair are internally joined under the igniter cord. As FIG. 6 shows best, in the molded body, at least one opening (4) is elongated with at least two inclined and opposite surfaces (5) that obliquely tend to converge toward the inside of the igniter cord (3) to channel the spread of ignition sparks toward an area (23) of an ignition fuse (22), which, in the example, is provided with a thermoplastic head (32), and that area (23) to be placed against the opening (4) in order to be ignited by the igniter cord (3) to propagate ignition to a pyrotechnic element (not represented) located outside the molded body (1).

Figure 2:
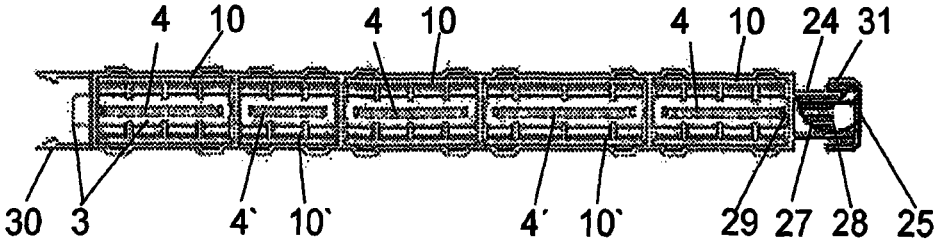
FIG. 2 shows on a similar scale and like FIG. 1, the main base of a molded body seen from below showing the igniter cord with ignition openings of different lengths, according to the invention.

Referring to the figures, especially FIG. 2, a series of openings (4) of equal length and openings (4') of different lengths are presented in the example following the same lengthwise alignment with the igniter cord (3), and this, although any other possible orientation could be used. All openings (4) and (4') including at least two inclined surfaces (5), facing each other and tending to converge toward the inside of the igniter cord (3) channeling the exit of the ignition flare and/or sparks from the igniter cord (3) to the outside to ignite each of the ignition fuses (22) held against the corresponding openings (4) and (4'). The separation between openings (4) and (4') corresponds to sections (6) without openings and whose lengthwise extensions determine the delay required for the ignition fuses (22). However, since the openings (4), (4') are allowed to be of different lengths in the example, these sections (6) are unequal to each other and proportional to the acceleration or delay required to ignite the ignition fuses (22).

Figure 1:
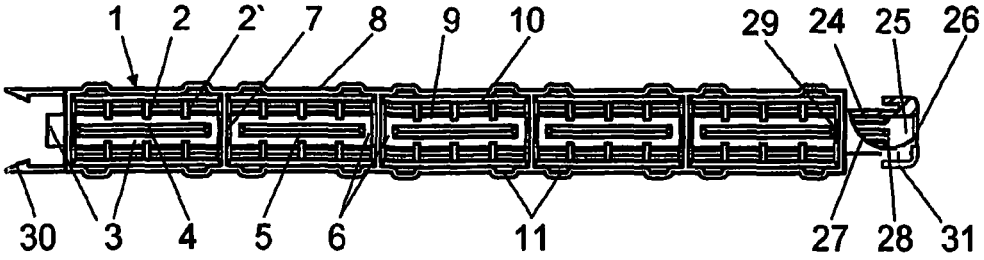
FIG. 1 shows the main base of a molded body seen from below to better show the ignition openings of equal length in the igniter cord, according to the invention.

As shown in FIG. 1, each of the openings (4), and each opening (4) and (4') in FIG. 2, between sections (6) of the igniter cord (3) is contained between partitions (7) that exceed the height of the ribs (2') and are presented in the example as parallel to each other, distributed along the molded body (1) and with a separation proportional to that required by the lengthwise extension and established separation between openings (4) and (4') in order to limit the propagation of the ignition flare and/or sparks between adjacent openings.

On each side of the igniter cord (3) and externally supporting the pairs of ribs (2') which, together with the bottom (9) define the housing (2), are seen side walls or flanks (8) of similar height to the partitions (7), where they match up with cavities (10) that keep the openings isolated from each other, also shown in FIGS. 4 and 6, with a separation proportional to that required by the length and established separation between openings, which prevent or limit the spread of the ignition flare or sparks from one opening to the adjacent opening. The flanks (8), in the area of their upper edges, provide slots impressed into portions of the wall (11) which, as best seen in FIGS. 4 and 5, extend into each flank (8) downward until aligning with corresponding retention sockets (12).

Just as seen in FIGS. 3 and 4, better in FIG. 3, the preferred holder (13) consists of a thermoplastic plate that has an adaptation surface (14) and an opposite surface (15). The plate that matches with the holder (13) that is easily bent in half for use as shown in FIG. 4, and from its smaller sides (16) protrude pairs of support flaps (17) on the upper edges of the flanks (8), limiting the penetration of the holder (13) into the cavity (10, 10') provided for its use. Protruding from the adaptation surface (14) of the holder (13) and under the pairs of support flaps (17) are seen pairs of tabs (18) for sliding into the guide path provided by the slots impressed into portions of the wall (11) and after the snap-in connection, to work with the retention sockets (12) sized to tightly receive the pairs of tabs (18) and thus act as an end stop for the holder (13) blocking its upward or downward slide in the corresponding cavity (10, 10') provided for its use, as shown best in FIG. 5.

On the surface (15), opposite the adaptation surface (14) on the thermoplastic plate constituting the holder (13) and near its smaller sides (16) protrusions (19) are seen that work together as stops to keep both sides apart when the plate that constitutes the holder (13), is bent in half according to FIG. 4, and the holder is ready to be inserted into the corresponding cavity (10, 10') in the molded body (1) as provided in FIG. 5. Returning to FIG. 3, a push bar (20) of suitable amplitude and height protrudes vertically on the surface (15) and is extended, centered with respect to the smaller sides (16), providing a lower and central notch (21) for containment and pushing, as shown in FIG. 4, on an area (23) of the ignition fuse (22) to place it against at least one such opening (4, 4').

In the example, the tubular body (24) lengthens one end of the molded body (1), and is intended to allow for tight insertion of the protruding portion of the final portion of the igniter cord (3) of a molded body (1) similar to the goal of obtaining an ignition arrangement for multiple pyrotechnic articles of greater length. Alternatively, the tubular body (24) allows for the adaptation of an ignition head or ignition initiating element, for example, an electrical initiator (not represented) capable of causing the ignition of the igniter cord (3) in the pyrotechnic arrangement. Additional connecting members (30) and (31) are provided at either end of the molded body (1) to ensure connection between adjacent molded bodies.

Consistent with the figures and as seen best in FIGS. 1 and 2, the tubular body (24) is provided with a tubular cavity (25), with a cross section appreciably equal to or even greater than the cross section of the protruding final portion of the igniter cord (3) of the molded body (1) to be lengthened. The tubular cavity (25) extends lengthwise and axially from the entrance opening (26) to several radial rails (27) which, decreasing the [cross] section of the tubular cavity (25), extend to the base (28) provided with a hole (29) to allow ignition propagation to the igniter cord (3) of the molded body (1) to be lengthened.

The invention claimed is:

1. An ignition arrangement for multiple pyrotechnic articles comprising a molded body including therein an igniter cord provided in a housing which extends lengthwise in the molded body, and at least one opening in the igniter cord, said igniter cord having access to the exterior of the housing;

wherein said at least one opening is included in a series of elongated openings spaced along the igniter cord in lengths proportional to acceleration or delay for ignition propagation, and said at least one opening has at least two opposing inclined surfaces which converge inside of said igniter cord to direct propagation of ignition sparks from the opening to the exterior of the housing and provide ignition to an ignition fuse of at least one pyrotechnic article located outside of the molded body;

wherein each opening of said series of elongated openings present in the igniter cord is contained in said molded body, bounded by partitions extending transversely in the housing and flanks extending parallel to the housing, to define a cavity which prevents projection of ignition sparks emitted from inside the opening in the igniter cord to the exterior of the molded body; and a holder formed by a thermoplastic plate that is folded to fit into the cavity, and which forces a region of the ignition fuse against said at least one opening.

2. The ignition arrangement of claim 1, wherein said holder is formed independently of the molded body and comprises an adaption surface which includes pairs of support flaps which limit penetration of the holder into the cavity of the molded body, and includes a pair of tabs to maintain the holder in the cavity, while a reverse side of the adaption surface includes cooperating stop protrusions that maintain separation between folded sides of the holder when fit into the cavity; and wherein said holder includes a push tab and a notch configured to contain and push on the ignition fuse against said at least one opening.

3. The ignition arrangement of claim 1, further comprising a tubular body extending coaxially from one end of said housing and toward the exterior of the molded body; wherein said tubular body includes a first cavity extending longitudinally and axially from an open end in said tubular body inside said housing to narrow in section to structure a second cavity for reception and holding of an external ignition head to the ignition arrangement.

4. The ignition arrangement of claim 1, further comprising connecting members, at each end of the molded body, configured to connect said molded body to one or more additional molded bodies containing igniter cords.

* * * * *